US008042434B2

(12) United States Patent
Junkers

(10) Patent No.: US 8,042,434 B2
(45) Date of Patent: Oct. 25, 2011

(54) SAFETY TORQUE INTENSIFYING TOOL

(76) Inventor: John K. Junkers, Saddle River, NJ (US)

( * ) Notice: Subject to any disclaimer, the term of this patent is extended or adjusted under 35 U.S.C. 154(b) by 167 days.

(21) Appl. No.: 12/120,346

(22) Filed: May 14, 2008

(65) Prior Publication Data

US 2009/0188353 A1 Jul. 30, 2009

Related U.S. Application Data

(60) Provisional application No. 61/023,151, filed on Jan. 24, 2008.

(51) Int. Cl.
*B25B 23/14* (2006.01)

(52) U.S. Cl. ..... 81/467; 81/54; 81/57; 81/57.11; 81/473

(58) Field of Classification Search ..... 81/54, 57, 81/57.11, 467, 473
See application file for complete search history.

(56) References Cited

U.S. PATENT DOCUMENTS

| | | | | |
|---|---|---|---|---|
| 4,155,278 | A | 5/1979 | Estok | |
| 4,484,871 | A * | 11/1984 | Adman et al. | 418/69 |
| 4,573,370 | A | 3/1986 | Clemens | |
| 5,046,900 | A | 9/1991 | Heiter et al. | |
| 5,730,232 | A | 3/1998 | Mixer | |
| 7,422,075 | B2 * | 9/2008 | Hahn | 173/178 |
| 7,497,147 | B2 | 3/2009 | Koppenhoefer | |
| 2005/0034276 | A1 | 2/2005 | Badiali | |
| 2005/0161241 | A1 | 7/2005 | Frauhammer et al. | |
| 2006/0211534 | A1 * | 9/2006 | Roberts et al. | 475/317 |
| 2007/0251359 | A1 | 11/2007 | Junkers | |
| 2009/0107297 | A1 | 4/2009 | Junkers | |

FOREIGN PATENT DOCUMENTS

| | | |
|---|---|---|
| DE | 20 2006 011 224 | 12/2007 |
| DE | 10 2008 042 436 | 4/2009 |
| EP | 1 690 638 | 8/2006 |
| GB | 1 574 652 | 9/1980 |
| GB | 2 410 205 | 7/2005 |
| GB | 2 454 353 | 5/2009 |
| JP | 9-295278 | 11/1997 |
| JP | 2006-346810 | 12/2006 |
| SU | 810 472 | 3/1981 |

* cited by examiner

*Primary Examiner* — Joseph J Hail
*Assistant Examiner* — Shantese McDonald
(74) *Attorney, Agent, or Firm* — Michael J. Striker

(57) ABSTRACT

A safety torque intensifying tool has a housing, a torque intensifying unit providing at least two modes of operation including a first mode in which the tool operates with a high speed and a low torque and a second mode in which the tool operates with a low speed and a high torque, a grip to be held by a tool operator, an additional element acting as a handle for better gripping in the first mode in which the tool operates with the high speed and low torque and also as a reaction arm to abut against a stationary object to stop the housing from turning in the second mode when the tool operates with the low speed and the high torque, and a switching unit for switching the tool between the first and second modes and configured so that when the operator does not act on the switching unit the tool is in the second mode of operation with the low speed and the high torque, and when the switching unit is switched by the operator while the additional element acts as a handle, the tool is switched to the first mode of operation with the high speed and the low torque, until the operator stops acting on the switching unit and the tool is switched itself back to the second mode of operation.

4 Claims, 2 Drawing Sheets

SAFETY TORQUE INTENSIFYING TOOL

CROSS-REFERENCE TO A RELATED APPLICATION

The invention described and claimed hereinbelow is also described in Provisional Application Ser. No. 61/023,151, filed Jan. 24, 2008. This Patent Application, the subject matter of which is incorporated herein by reference, provides the basis for a claim of priority of invention under 35 U.S.C. 119(a)-(d).

BACKGROUND OF THE INVENTION

The present invention relates to torque intensifying tools.

Torque intensifying tools may have several different applications in several different fields. One typical field of application relates to industrial torque wrenches for the fastening and loosening of nuts and bolts.

When torque intensifying tool is used in connection with the fastening or loosening of industrial nuts or bolts, the torque intensifying tool typically will have at least two modes of operation. In a first mode of operation the torque intensifying tool will operate with a high speed and a low torque. This is normally accomplished by deactivating some of the multiple gear cages within the tool. A second mode of operation will take place when the torque intensifying tool operates with a low speed but a high torque. This is normally accomplished when all gear cages are rendered operational.

In bolting applications, the high speed/low torque mode is used, for example, to run down a bolt until it is fully inserted into an object and its head abuts the object to which it is to be affixed.

The low speed/high torque mode is then used in the final operation of tightening the bolt in the object wherein higher torque and lower speed is required.

At high speed/low torque, the torque intensifying tool creates a reaction force which is transmitted to the handle, held by the operator, connected to the tool housing. The reaction force is relatively low and will normally be absorbed by the operator holding the handle.

Accordingly, a tool operator may normally be able to hold the tool handle provided that the handle is not subject a torque in excess of 5 ft. lbs. This means that in the tool, in which the torque intensifying means may create a torque of up to 50 in. lbs at the high speed the operator holding the handle can stop the housing from rotation.

In the second mode of operation when the torque intensifying tool is operated with a high speed/low torque, the handle of the tool is typically switched from a perpendicular position relative to the housing to a position corresponding to the general direction of the housing, to abut against a stationary object and thereby to stop the housing from turning in the opposite direction to the active force of the tool.

In a high speed/low torque mode of operation the handle must be held in its perpendicular position relative to housing in a stationary manner by the operator, so as not to permit the housing to rotate at high speed. In such operation the inertia created by the weight of the arm and the speed could injure the operator if the operator's hands were to be in the way of handle rotation.

One improvement of the subject invention is to provide for at least two modes of operation, one high speed/low torque and one low speed/high torque, in which it is assured that while the tool is used at high speeds/low torque, operator injury as a result of twisting the arm or moving parts at high speed or hitting against the stationary object can be avoided.

SUMMARY OF THE INVENTION

Accordingly, it is an object of the present invention to provide a safety torque intensifying tool, which is a further improvement of the existing torque intensifying tools.

More particularly, it is an object of the present invention to provide a safety torque intensifying tool, which is safer in operation than the existing torque intensifying tools.

In keeping with these objects and with others which will become apparent hereinafter, one feature of the present invention resides, briefly stated, in a safety torque intensifying tool, comprising a housing; torque intensifying means accommodated in said housing and operative for providing at least two modes of operation including a first mode in which the torque intensifying tool operates with a high speed and a low torque and a second mode in which the torque intensifying tool operates with a low speed and a high torque; a grip to be held by an operator; an additional element acting as a handle for better gripping in said first mode in which the torque intensifying tool operates with the high speed and low torque and also acting as a reaction arm to abut against a stationary object to stop said housing from turning in said second mode when the torque intensifying tool operates with the low speed and high torque; and switching means for switching the intensifying tool between said first and second modes and configured so that when the tool operator does not act on said switching means the torque intensifying tool is in said second mode with a low speed and a high torque and when said switching means is acted on by the tool operator while said additional element acts as a handle, the torque intensifying tool is switched to said first mode with a high speed and a low torque until the tool operator again stops acting on said switching means and the torque intensifying means is switched itself back to said second mode of operation.

In the safety torque intensifying tool, when a tool operator does not act on the tool, the tool is held in the position in which it is in the above mentioned second mode of operation with the low speed and the high torque. Only when the tool operator acts on the tool or on the switching means of the tool while the additional element acts as a handle, the tool is switched to the first mode of operation with the high speed and low torque, in which first mode of operation the additional element act as the handle. When the tool operator stops acting on the switching means of the tool, the tool is switched back to the second mode operation with the low speed and high torque.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a view showing a part of an element of torque intensifying means of the inventive tool.

DESCRIPTION OF THE PREFERRED EMBODIMENTS

Figure 1:
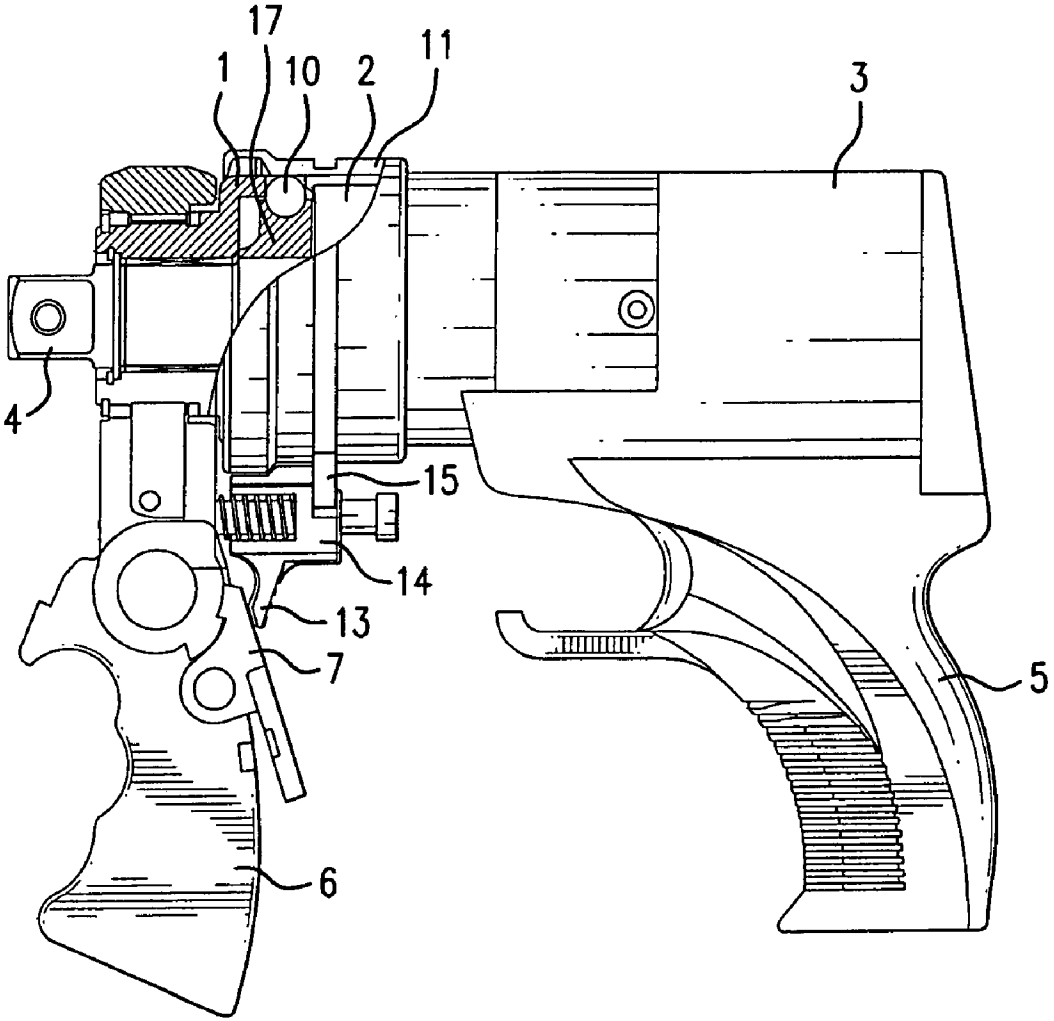
FIG. 1 is a view showing a safety torque intensifying tool in accordance with the present invention in a first mode of operation with a high speed and a low torque.

A torque intensifying tool in accordance with the present invention has a housing which is identified with reference numeral 1. The housing 1 accommodates torque intensifying means identified as a whole with reference numeral 2 and a drive which is identified with reference numeral 3.

The torque intensifying means 2 include a plurality of gears and is connected at one end with the drive 3 and at the other end with a driving element 4. The torque intensifying means 2, as known in the art, can include a plurality of gear elements which are connected with one another and configured so that when the torque intensifying means is driven by the drive 3, it reduces a speed and increases a torque, so as to provide a corresponding output torque on the driving element 4.

The driving element 4 is engageable with a fastener, such as a nut, a bolt, etc. to turn the fastener, for example for tightening or loosening the fastener. The drive 3 can be formed for example as an electric motor, a hydraulic motor, etc. as known in the art.

The torque intensifying tool is further provided with a grip 5 which is also known per se in the art. The grip 5 is connected with the housing 1 and configured to be held by a tool operator.

The torque intensifying tool of the present invention has an additional element 6 which performs, depending on the mode of the operation of the tool, two different functions. In the position of the element 6 shown in FIG. 1 the element 6 extends substantially perpendicular to the housing 1 so as to operate as an additional handle for a better grip by the tool operator, which in this situation can hold both the grip 5 and the element 6 with his two hands. In the position shown in FIG. 2 the element 6 is turned to extend substantially along the housing 6 and to abut against a neighboring stationary object so as to absorb a reaction force which is created when the torque intensifying tool is operated for turning the fastener with an action force.

In each position the element 6 can be temporarily fixed by a known fixing means. The fixing means can be formed, for example, as a pawl 7 which engages with its tooth 8 a corresponding side of a projection 9.

Figure 2:
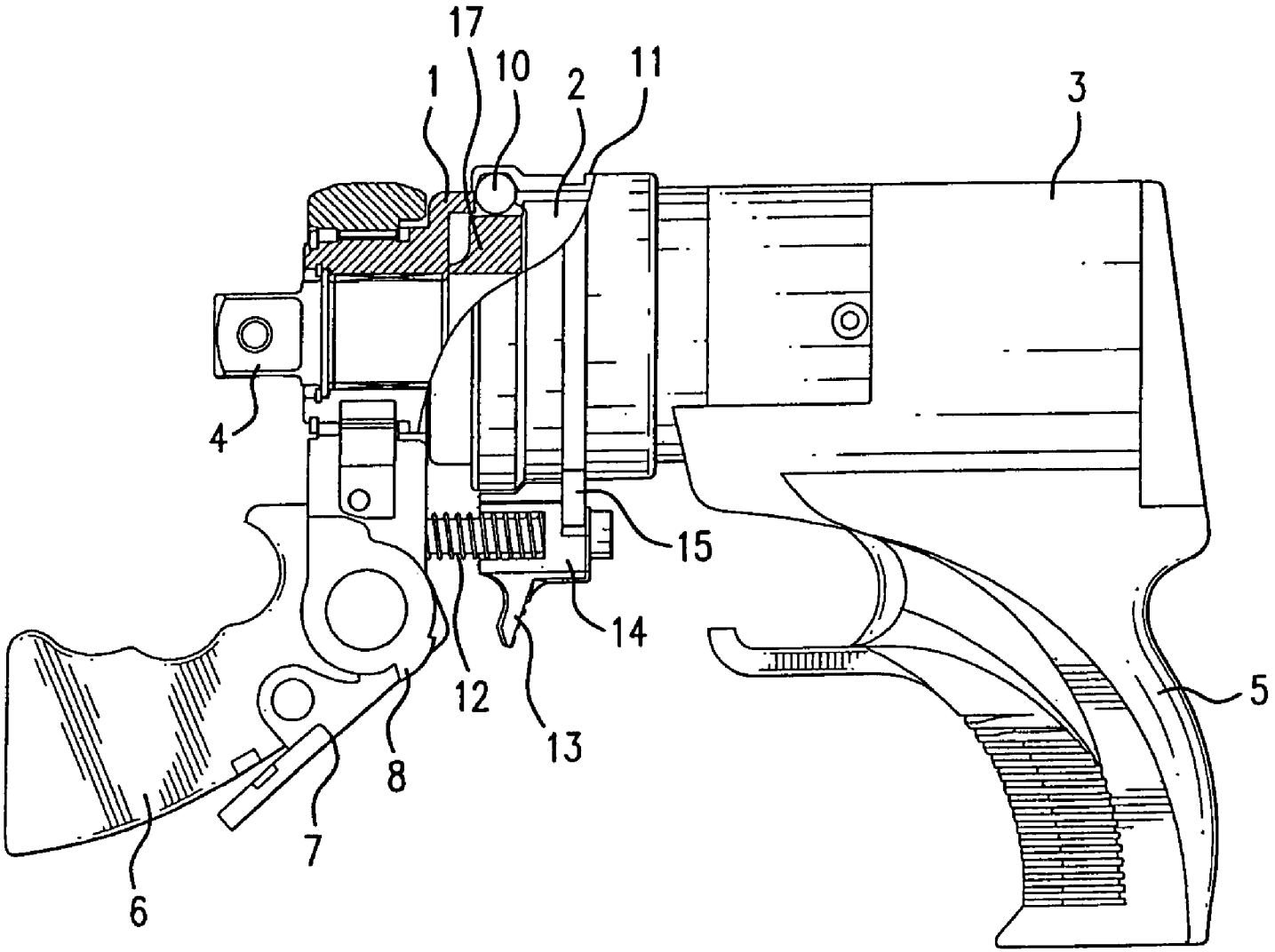
FIG. 2 is a view showing the safety torque intensifying tool in accordance with the present invention in a second mode of operation with a low speed and a high torque.

The torque intensifying tool in accordance with the present invention further has means for switching between two modes of operation, including a first mode in which the tool operates with a high speed and a low torque as shown in FIG. 1, for example during initial turning of a fastener, such as a nut on a bolt, to reach an object for example two plates to be connected with one another by the fastener, and a second mode in which the torque intensifying tool operates with a low speed and high torque as shown in FIG. 2 to tighten the fastener, for example the bolt, in the object.

In the first mode of operation the housing 1 and the torque intensifying means 2 are connected with one another for joint turning, and they jointly rotate the driving element 4, while in the second mode of operation the torque intensifying means 2 is disconnected from the housing 1 and the torque intensifying means 2 directly rotate the driving element 4 to turn a fastener.

The switching means in the torque intensifying tool can include for example a ball 10, which in the first mode of operation is located in an opening provided in the housing 1 and is also engaged in one of the recesses 16 provided in an element 17 of the torque intensifying means 2, for example its last stage, while in the second mode of operation the ball 10 is disengaged from the recess 16 of the element 17 of the torque intensifying means 2 and is located only in the opening of the housing 1.

For displacing the ball 10 between the above mentioned two positions, a ring-shaped shifting element 11 is provided, which is spring-loaded with a spring 12. When a tool operator does not activate the switching means the spring 12 displaces the shifting element 11 to the right in FIG. 2 so that the shifting element 11 allows the ball 10 to disengage from the recess 16 of the element 17 of the torque intensifying means 2 and to be confined in the opening of the housing 1, and therefore that the housing 1 does not rotate together with the torque intensifying means 2. The tool operates in the second, low speed, high torque mode.

When a tool operator displaces the shifting element 11, for example by pressing a projection 13 of an actuating member 14 which via a bearing 15 engages in a groove of the shifting element 11, to the left in the drawings as shown in FIG. 1, a part of the shifting element 11 that has a smaller diameter moves over the ball 10 and presses it into the recess 16 of the element 17 of the torque intensifying means 2, thus actually connecting the torque intensifying means 2 with the housing 1 for joint rotation under the action of the drive 3. The tool then operates in the first, high speed, low torque mode.

When the tool operator releases a pressure applied by him to the projection 13, the shifting element 11, under the action of the spring 12, is automatically displaced to the right, back to the position shown in FIG. 2 in which the torque intensifying tool operates with a low speed and a high torque.

As can be seen from the drawings and described herein above when the torque intensifying tool is in the position shown in FIG. 1 in which it operates with a high speed and a low torque, the element 6 extends substantially perpendicular to the housing and serves as an additional handle, while in the position shown in FIG. 2 when the torque intensifying tool operates with a low speed and a high torque, the element 6 is turned to extend substantially along the housing and to abut against a neighboring object to absorb a reaction force generated during turning a fastener by the driving element 4, to be tightened and loosened by an active force.

It will be understood that each of the elements described above, or two or more together, may also find a useful application in other types of constructions differing from the type described above.

While the invention has been illustrated and described as embodied in a torque intensifying tool, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

The invention claimed is:

1. A safety torque intensifying tool, comprising a housing; a drive; torque intensifying means for intensifying a torque of said drive, accommodated in said housing and operative for providing at least two modes of operation including a first mode in which the torque intensifying tool operates with a high speed and a low torque and a second mode in which the torque intensifying tool operates with a low speed and a high torque; a grip to be held by a tool operator; an additional element acting as a handle for better gripping in said first mode in which the torque intensifying tool operates with the high speed and the low torque and also as a reaction arm to abut against a stationary object to stop said housing from turning in said second mode when the torque intensifying tool operates with the low speed and the high torque; and switching means for switching the torque intensifying tool between said first and second modes and configured so that when the tool operator does not act on said switching means the torque intensifying tool is in said second mode of operation with the low speed and the high torque and when said switching means is acted on by the tool operator while said additional element acts as a handle, the torque intensifying tool is switched to said first mode of operation with the high speed and the low torque, until the tool operator stops acting on said switching means and the torque intensifying tool is switched itself back to said second mode of operation.

2. A safety torque intensifying tool as defined in claim 1, wherein said housing and said torque intensifying means are configured so that in said first mode of operation said housing and said torque intensifying means are turned by the drive jointly to turn a fastener, while in said second mode of operation only said torque intensifying means is turned by the drive to turn the fastener.

3. A safety torque intensifying tool as defined in claim 1, wherein said switching means is configured so as alternatingly to connect said torque intensifying means with said housing for joint turning by the drive in said first mode of operation and to disconnect said torque intensifying means from said housing in said second mode of operation for turning only said torque intensifying means by the drive.

4. A safety torque intensifying tool, comprising a housing; a drive; torque intensifying means for intensifying a torque of said drive, accommodated in said housing and operative for providing at least two modes of operation including a first mode in which the torque intensifying tool operates with a high speed and a low torque and a second mode in which the torque intensifying tool operates with a low speed and a high torque; a grip to be held by a tool operator; an additional element acting as a handle for better gripping in said first mode in which the torque intensifying tool operates with the high speed and the low torque and also as a reaction arm to abut against a stationary object to stop said housing from turning in said second mode when the torque intensifying tool operates with the low speed and the high torque; and switching means for switching the torque intensifying tool between said first and second modes and configured so that when the tool operator does not act on said switching means while said additional element is in a position acting as the reaction arm the torque intensifying tool is in said second mode of operation with the low speed and the high torque and when said switching means is acted on by the tool operator while said additional element is in a position acting as the handle, the torque intensifying tool is switched to said first mode of operation with the high speed and the low torque, until the tool operator stops acting on said switching means and the torque intensifying tool is switched itself back to said second mode of operation.

* * * * *